US009875868B2

(12) United States Patent
Cheng et al.

(10) Patent No.: US 9,875,868 B2
(45) Date of Patent: Jan. 23, 2018

(54) LOCKING DEVICE FOR HIGH-VOLTAGE SWITCHGEAR

(71) Applicant: ABB Schweiz AG, Baden (CH)

(72) Inventors: Daniel-Jun Cheng, Xua hua Hebei (CN); James-Sheng Qiang Li, Beijing (CN); JianMei Wang, Beijing (CN); Severin Neubauer, Zürich (CH); Markus Widenhorn, Stein am Rhein (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/233,528

(22) Filed: Aug. 10, 2016

(65) Prior Publication Data

US 2017/0047179 A1 Feb. 16, 2017

(30) Foreign Application Priority Data

Aug. 10, 2015 (DE) ..... 10 2015 113 160

(51) Int. Cl.
*H01H 9/28* (2006.01)
*H01H 27/06* (2006.01)
(Continued)

(52) U.S. Cl.
CPC ..... *H01H 27/06* (2013.01); *H01H 3/227* (2013.01); *H01H 3/44* (2013.01); *H01H 9/24* (2013.01);
(Continued)

(58) Field of Classification Search
CPC .... H01H 71/02; H01H 71/0264; H01H 71/10; H01H 71/1009; H01H 71/1054;
(Continued)

(56) References Cited

U.S. PATENT DOCUMENTS 7,943,873 B2 5/2011 Gopikrishnan Babu et al.
8,654,513 B2 * 2/2014 Bower ..... H02B 11/127 200/50.24
(Continued)

FOREIGN PATENT DOCUMENTS

DE 3710374 A1 10/1988
DE 4142548 A1 6/1993
(Continued)

OTHER PUBLICATIONS

German Patent Office, Search Report issued in corresponding Application No. 102015113160.9, dated Jan. 11, 2016, 7 pp.
(Continued)

*Primary Examiner* — Anthony R. Jimenez
(74) *Attorney, Agent, or Firm* — Taft Stettinius & Hollister LLP

(57) ABSTRACT

The device is used for locking an access for actuating two switching devices of high-voltage switchgear with the aid of a drive shaft transmitting drive force onto the two switching devices. In order to increase the operational safety of the high-voltage switchgear with little outlay, the locking device comprises a closing disk which is fastened on the drive shaft, a rocker bar arrangement containing at least four rocker bars, and a slider. The slider can be moved, on-site, into two positions, the first of which releases an access for the actuation on-site and blocks an access for the actuation from a remote location, and the second of which blocks the access for the on-site actuation and releases the access for the remote actuation.

20 Claims, 5 Drawing Sheets

(51) Int. Cl.
*H01H 3/22* (2006.01)
*H01H 3/44* (2006.01)
*H01H 9/24* (2006.01)

(52) U.S. Cl.
CPC ..... *H01H 9/282* (2013.01); *H01H 9/285* (2013.01); *H01H 2239/044* (2013.01); *H01H 2300/018* (2013.01)

(58) Field of Classification Search
CPC ..... H01H 71/128; H01H 71/50; H01H 71/52; H01H 71/66; H01H 2003/00; H01H 2003/02; H01H 2009/0088; H01H 2009/0094; H01H 2071/10; H01H 2071/1009; H01H 2071/1054; H01H 2071/50; H01H 27/06; H01H 3/227; H01H 3/44; H01H 9/24; H01H 9/282; H01H 9/285; H01H 2239/044; H01H 2300/018
USPC ..... 200/43.04, 43.08, 50.21–50.27, 43.11, 200/50.01, 50.03, 17 R, 43.01, 50.18, 200/50.24, 50.34, 293, 322, 324, 336, 200/337, 43.16; 71/2, 264, 10, 128, 50, 71/52, 66
See application file for complete search history.

(56) References Cited

U.S. PATENT DOCUMENTS

2008/0142343 A1* 6/2008 Manz ..... H01H 3/227
200/43.11
2009/0173611 A1* 7/2009 Suter ..... H01H 3/3026
200/336

FOREIGN PATENT DOCUMENTS

| | | | |
|---|---|---|---|
| EP | 1271588 | A1 | 1/2003 |
| EP | 1933345 | A1 | 6/2008 |
| EP | 2110909 | A2 | 10/2009 |
| JP | 2002152922 | A | 5/2002 |
| WO | 02080323 | A1 | 10/2002 |

OTHER PUBLICATIONS

"Generator Circuit-Breaker Systems HECS," Product Brochure, ABB Switzerland Ltd, High Voltage Products, Zurich, Switzerland, 6 pp.

* cited by examiner

LOCKING DEVICE FOR HIGH-VOLTAGE SWITCHGEAR

TECHNICAL FIELD

The present invention relates to a device for locking an access for actuating two switching devices of high-voltage switchgear.

The high-voltage switchgear contains an actuating device which transfers drive force from a drive shaft to a contact arrangement of a first of the two switching devices and to a contact arrangement of a second of the two switching devices. The two switching devices have different functions and are generally suitable for connecting or disconnecting currentless or nearly currentless electric circuits. Such switching devices are frequently used as a disconnect switch/grounding switch system on the transformer side or as a start-up switch/grounding switch system on the generator side of high-voltage switchgear which is designed as a generator circuit-breaker system and is then typically operated at nominal voltages between a few kV and 70 kV to 80 kV. However, they can also be used in gas-insulated switchgears or in outdoor switchgears having nominal voltages of up to 1000 kV. The circuit-breaker systems, which are generally single-phase, are mechanically connected to one another by means of coupling rods when used in multiphase, high-voltage switchgears.

The two switching devices can assume three switch positions. In a neutral position, the two switching devices are open. In a first active position, the first switching device, for example, a disconnect switch, is closed and the second switching device, for example, a grounding switch, is open. In the second active position, the first switching device is open and the second switching device is closed. In order to prevent one of these three switch positions from being activated if the two switching devices assume one of the remaining two switch positions, the high-voltage switchgear requires a locking device which blocks the access for actuating the two switching devices if an attempt is made to switch on-site, for example with the aid of a crank handle.

PRIOR ART

A locking device for a generator switch is described in EP 1 933 345 B1. This device comprises two ratchet wheels disposed on an actuating shaft, one of which can be blocked by a first of two pawls when the shaft is rotated in the clockwise direction and the other of which can be blocked with the aid of the second pawl when the shaft is rotated in the counterclockwise direction. An access for actuating a generator switch can be locked in this way.

Devices which transfer drive force from a drive shaft, which can be rotated in the clockwise or counterclockwise direction, to a contact arrangement of a first switching device of high-voltage switchgear and to a contact arrangement of a second switching device of high-voltage switchgear, so-called three-position drives, are described in DE 37 10 374 A1, WO 02/080 323 A1 and JP 2002/152922 A.

In the case of the two actuating devices mentioned first (DE 37 10 374 A1 and WO 02/080 323 A1), a movable contact is fastened on the axle, which can be contacted in an electrically conducting manner, depending on the rotational angle, to a fixed contact of a disconnect switch or to a fixed contact of a grounding switch or, in a neutral position, to neither of the two fixed contacts. Three positions therefore result, depending on the rotational angle. In a first position, the grounding switch is closed and the disconnect switch is open. In a second position, the disconnect switch is closed and the grounding switch is open and, in a third position, the disconnect switch and the grounding switch are open. Since the movable contact can be contacted to the two fixed contacts of the disconnect switch and of the grounding switch, all the contacts must have a diameter which is dimensioned for both switches, even though a smaller diameter would suffice for one of the two switches. This increases the costs and the amount of space required for the actuating device.

In the case of the latter actuating device (JP 2002/152922 A), three gates are fastened on the driven axle. Each gate controls the sequence of motions of a movable contact of one of the three associated switching devices. This actuating device includes—as is also the case with the related art according to DE 37 10 374 A1—a Geneva drive which drives the drive shaft, thereby ensuring that the switching devices can only have predefined switching states. This actuating device requires a separate gate for each of the three switching devices, which is installed in the associated switching device instead of a linkage as is usually used.

A further actuating device comprising a drive shaft, which, in a first active position of the two switching devices, is rotated in the clockwise direction through a base angle and, in a second active position of the two switching devices, is rotated in the counterclockwise direction through the base angle relative to the angle position of the drive shaft in a neutral position of the two switching devices, is described in the application having file number 10 2915 110 971.9, which was submitted on Jul. 7, 2015.

High-voltage switchgear, in which an actuating device of the type mentioned at the outset can be used, is described in the product brochure entitled "Generator Circuit-Breaker Systems HECS" from the company ABB Schweiz AG, Zurich/Switzerland (1HC0072302 E02/AA09). This high-voltage switchgear is designed as a generator circuit-breaker system and has a disconnect switch/grounding switch system on the transformer side of a load-switching pole of a generator circuit-breaker, and a start-up switch/grounding switch system on the generator side of the circuit-breaker pole.

PRESENTATION OF THE INVENTION

The problem addressed by the invention as described in the claims is that of providing a locking device of the type mentioned at the outset, which is simple and compact and increases the operational safety of high-voltage switchgear equipped with this locking device.

According to the present invention, a device for locking an access for actuating two switching devices of high-voltage switchgear with the aid of a drive shaft transmitting drive force onto the two switching devices is provided, said drive shaft being rotated, in a first active position of the two switching devices, in the clockwise direction through a base angle and, in a second active position of the two switching devices, being rotated in the counterclockwise direction through the base angle relative to its angle position in a neutral position of the two switching devices.

This locking device comprises a closing disk which is fastened on the drive shaft, a rocker bar arrangement containing at least four rocker bars, and a slider, wherein the slider can be moved, on-site, into two positions, the first of which releases an access for the actuation on-site and blocks an access for the actuation from a remote location, and the second of which blocks the access for the on-site actuation and releases the access for the remote actuation, wherein, in the first position of the slider, a first rocker bar can engage into the closing disk, in the first active position, and a second rocker bar can engage into the closing disk, in the second active position, depending on the on-site position, and, in the neutral position, a third rocker bar and a fourth rocker bar can engage into the closing disk, and wherein the slider, in its second position, blocks the first and the second rocker bars.

The locking device according to the invention is simple and compact and can also be easily retrofitted into the high-voltage switchgear. The locking device makes it possible for trained, authorized personnel to lock or unlock, on-site, the access for a manual actuation of the two switching devices or the access for an actuation of the two switching devices with the aid of motors which are controlled from a remotely located control room. The locking device, having the slider on one side and the rocker bar arrangement and the closing disk on the other side, comprises two mechanical components which can be actuated independently of one another, but which cooperate with one another during a locking process or an unlocking process during operation of the high-voltage switchgear. Given that the slider and the rocker bar arrangement are actuated independently of one another, the slider can be used to activate or block, on-site, the access for the remote actuation or for the on-site actuation of the two switching devices. After the access for the on-site actuation has been activated, the two switching devices can be unlocked, on-site, using the rocker bar arrangement, and can then be manually moved into the neutral position or into one of the two active positions using a crank handle, and can then be locked using the rocker bar arrangement and the closing disk. Since only simple and robust mechanical components, such as the slider, the closing disk, and the rocker bar arrangement, are required therefor, the locking device according to the invention, which has a simple and compact design, is distinguished by a high level of operating comfort and great operational safety.

The slider and the four rocker bars can each be rotatably supported in one of five locks inserted through a housing wall on an operating side of the locking device.

The slider can be moved from the first position into the second position by turning a key which has been inserted into the associated lock and can be moved from the second position into the first position by turning the key in the opposite direction. After the key has been withdrawn, the slider can be blocked in the first or the second position.

Each of the four rocker bars can be moved into a closed position, in which the rocker bar engages into the closing disk and forms a form-locked connection, by turning a key, which has been inserted into the associated lock, and removing the key, and each of the four rocker bars can be moved into an opened position, in which the rocker bar is disengaged from the closing disk, by re-inserting the key and turning it in the opposite direction, wherein each of the four rocker bars is blocked in the closed position after the key is withdrawn.

On the side of the housing wall facing away from the operating side, the slider can include a holding arc having two marginal cut-outs, and the first and the second rocker bars can have a first and a second circular disk, respectively, each of which is provided with a marginal cut-out, wherein, in the second position of the slider, the holding arc has been inserted into the marginal cut-out of the first circular disk and into the marginal cut-out of the second circular disk, forming a form-locked connection, and wherein, in the first position of the slider, the two marginal cut-outs of the holding arc release a blocking of the first and the second rocker bars.

The slider can include an arm which, in the second position of the slider, switches a switching element on, said switching element being used to switch a power supply on and off for the remote-controlled actuation of the switchgear.

The closing disk can have cut-outs and, during locking, the first rocker bar can engage into a first of the cut-outs in the first active position and, in the second active position, the second rocker bar can engage into a first of the cut-outs, forming a form-locked connection, and, in the neutral position, the third and the fourth rocker bars can engage into a second one of these cut-outs.

The third and the fourth rocker bars can be acted upon by a preload counter to their direction of rotation from the open position into the closed position. The preload can be applied by two torsion springs, wherein one end of at least one of the two springs is fixed and the other end is held on one of the two rocker bars. The preload prevents the two rocker bars from engaging into the second cut-out of the closing disk in an uncontrolled manner, which is typically caused by vibrations. As a result, the two rocker bars remain in form-locked engagement with the closing disk only if the keys have been withdrawn from the associated locks.

The closing disk can be situated between two fixed plates which are oriented perpendicular to the shaft and through which the shaft extends. At least four openings can be formed in the two plates in such a way that, during locking, in the first active position, a rockable engagement body of the first rocker bar is inserted through a first of the at least four openings and, in the second active position, a rockable engagement body of the second rocker bar is inserted through a second of the at least four openings, forming a form-locked connection with the closing disk in each case, and, in the neutral position, a rockable engagement body of the third rocker bar is inserted through a third of the at least four openings and a rockable engagement body of the fourth rocker bar is inserted through a fourth of the at least four openings, forming a form-locked connection with the closing disk.

Each of the two plates can have four openings which are mirror-symmetrically disposed on both plates, forming four pairs of openings, wherein, during locking, the engagement body of at least one of the four rocker bars is inserted through at least one of the four pairs, forming the form-locked connection with the closing disk.

At least one of the two plates can be integrated into a main body which has a U-shaped profile and has two limbs attached to this plate. A section of at least one of the four rocker bars, which is rotatably supported on the operating side, can be inserted through at least one of the two limbs and can be rotatably supported on both limbs.

The invention also relates to high-voltage switchgear comprising at least one locking device according to one of claims 1 to 12, which switchgear is designed as a generator circuit-breaker system and can be installed in a multi-phase high-voltage network, between a generator and a transformer, and has a disconnect-switch pole and a grounding switch on the transformer side of a load-switching generator circuit-breaker pole, or which is designed as a generator circuit-breaker system and can be installed in a multi-phase high-voltage network, between a generator and a transformer, and has a pole of a start-up switch and a grounding switch on the generator side of a load-switching generator circuit-breaker pole.

BRIEF DESCRIPTION OF THE DRAWINGS

The invention is described in greater detail in the following with reference to drawings. In the drawings.

WAYS TO CARRY OUT THE INVENTION

Figure 1:
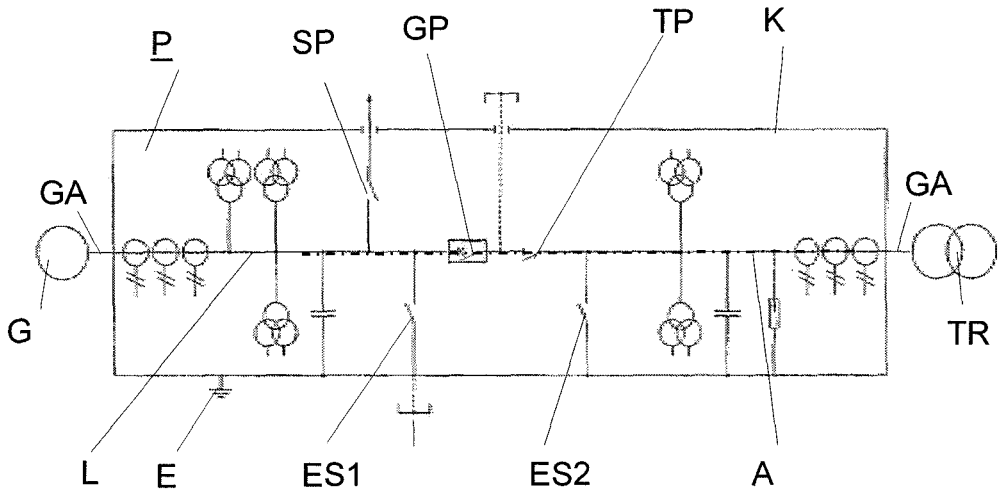
FIG. 1 shows a single-phase representation of multi-phase, high-voltage switchgear according to the prior art, which is designed as a multi-phase generator circuit-breaker system and has multiple circuit-breaker poles which are situated in a generator lead between a generator of a power plant and a transformer of a high-voltage transmission network.

The multi-phase generator circuit-breaker system represented as a single phase in FIG. 1 shows only one of several largely similarly designed circuit-breaker system poles P which are oriented parallel with one another and parallel with a horizontally extending axis A. The poles are arranged in a horizontally extending plane and are connected along a generator lead GA, which is oriented along the axis, between a generator G of a power plant and a transformer TR of a high-voltage transmission network. The pole P which is shown is single-phase and enclosed and has an encapsulation K which is generally made from metal, is electrically conductively routed to ground E, and is filled with ambient air. The encapsulation K accommodates a phase conductor L which is routed parallel to the axis A and in which a circuit-breaker pole GP of a multi-phase generator circuit-breaker and a circuit-breaker pole TP of a multi-phase disconnect switch are connected in series. A connection point of the phase conductor L located between a generator-side input point of the pole P and the generator circuit-breaker pole GP is connected to a current connection of a circuit-breaker pole SP of a multi-phase start-up switch, the other current connection of which is connected to a start-up device, typically for a gas turbine, located outside the encapsulation K. The encapsulation accommodates not only further components, such as overvoltage protection devices and current and voltage converters, but also two grounding switches ES1 and ES2, one of which, specifically ES1, electrically conductively connects a generator-side current connection when closed, and the other, specifically ES2, electrically conductively connects a transformer-side current connection of the system pole P when closed, to the encapsulation K and, therefore, also to ground E. A circuit-breaker system provided on the generator side of the load-switching circuit-breaker pole GP includes the circuit-breaker pole SP of the multi-phase start-up switch and the grounding switch ES1, whereas a circuit-breaker system provided on the transformer side includes the circuit-breaker pole TP of the multi-phase disconnect switch and the grounding switch ES2.

Each of the two circuit-breaker systems has a device for actuating a contact arrangement of the circuit-breaker pole SP or TP, respectively, and of the associated grounding switch ES1 or ES2, respectively. One of these two devices is explained in the following with respect to the circuit-breaker system containing the two switches TP and ES2. A similarly designed, second of these two devices is suitable for actuating the contact arrangements of the circuit-breaker pole SP and of the grounding switch ES1 in an analogous manner. The actuating device allows for only one neutral position and two active positions. In the neutral position, both switches are open, whereas, in a first of the two active positions, the grounding switch ES1 or ES2 is closed and the switch SP or TP is open and, in the second active position, the grounding switch ES1 or ES2 is open and the circuit-breaker pole SP or TP is closed. In any case, the actuating device is designed in such a way that a simultaneous closing of the two switches SP and ES1 or TP and ES2 is ruled out.

Figure 2:
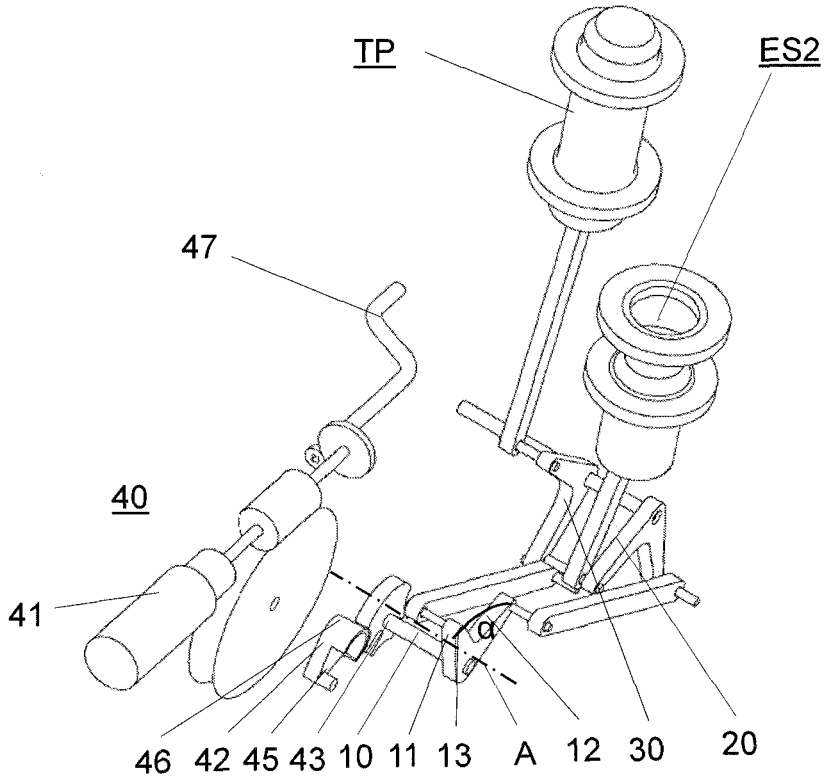
FIG. 2 shows a perspective representation of a device for actuating a contact arrangement of a first switching device, and for actuating a contact arrangement of a second switching device of the generator circuit-breaker system according to FIG. 1, in which the first switching device is closed and the second switching device is open.

It is apparent in FIG. 2 that this device comprises a drive shaft 10, which is rotatable about an axis A and on which a bent lever having two lever arms 12 and 13 enclosing a base angle $\alpha$ is fastened. The shaft 10 transfers force via a lever mechanism 20 containing the lever arm 12 to a contact arrangement of the circuit-breaker pole TP and via a lever mechanism 30 containing the lever arm 13 to a contact arrangement of the grounding switch ES2.

The shaft 10 is coupled to an intermittent-motion mechanism 40 designed as a Geneva drive. The Geneva drive includes a drive disk 42, which can be rotated by a drive 41 in the clockwise or counterclockwise direction and which has a crank pin 45 and a holding arc 46, and a slotted wheel 43 which is seated on the shaft 10 and has cut-outs 461, 462 and 463 which match the holding arc 46 and are visible in FIG. 3.

Figure 3:
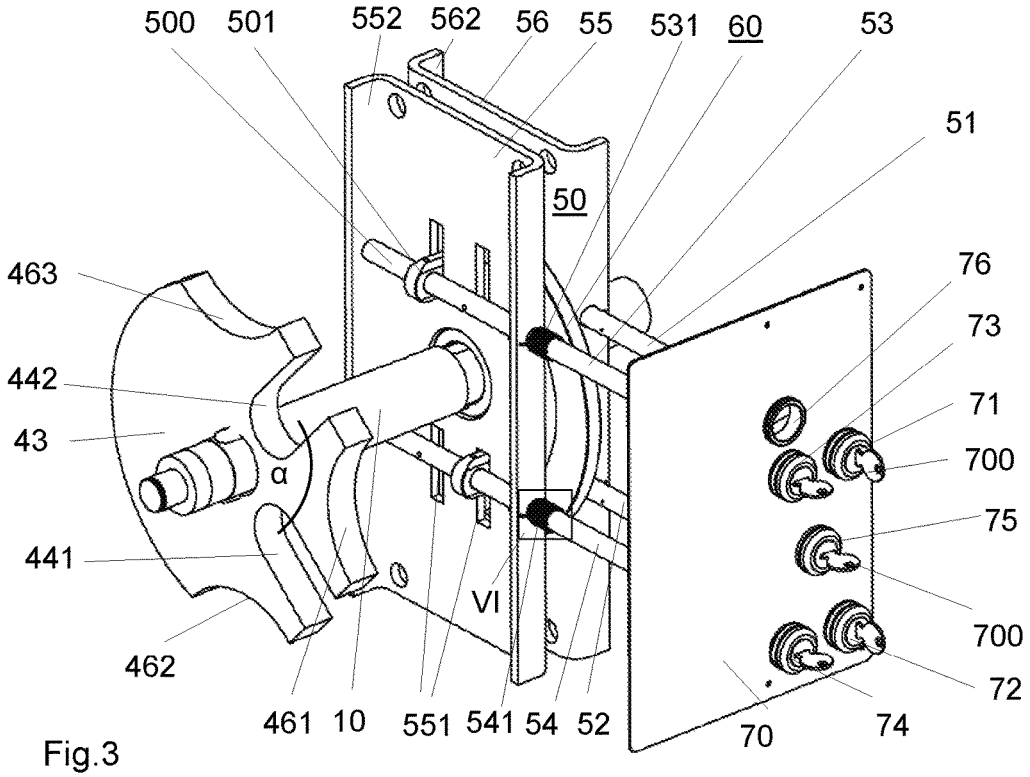
FIG. 3 shows a perspective view of one embodiment of the locking device according to the invention, which is installed in the actuating device according to FIG. 2 and locks the two switching devices in a neutral position.

FIG. 3 shows that two radially oriented grooves 441, 442 are formed in the slotted wheel 43 and are disposed so as to be offset with respect to one another about the predefined base angle $\alpha$ in the circumferential direction of the primary shaft 10. The base angle is typically between 70° and 110°. In a position of the slotted wheel 43 shown in FIG. 3, the Geneva drive is situated in the neutral position, in which the two switching devices TP and ES2 are open. The crank pin 45 of the drive disk 42 is then located outside the two grooves 441, 442. The cut-out 461 resting against the holding arc 46 secures the neutral position against an unintentional rotation of the shaft 10. When the drive disk 42 rotates in the clockwise direction, the crank pin 45 engages into the groove 441, and so the slotted wheel 43 and, therefore, the drive shaft 10 rotate through the base angle α in the counterclockwise direction. In this way, the first active position is reached, in which a first of the two switching devices is closed, whereas the second switching device is open. In the first active position, the cut-out 462 rests against the holding arc 46 and thereby secures this position against a rotation of the primary shaft. This applies, correspondingly, when the drive disk 42 is rotated in the counterclockwise direction. The crank pin 45 engages into the groove 442, and so the slotted wheel 43 and, therefore, the drive shaft 10 rotate through the base angle in the clockwise direction. In this way, the second active position is reached, in which the second switching device is closed, whereas the first switching device is open. In the second active position, the cut-out 463 rests against the holding arc 46 and thereby secures this position against a rotation of the drive shaft 10.

The above-described actuating device is actuated, in general, from a remotely located control room and therefore has an electrical connection to the control room, which is suitable for transmitting power current and electrical signals. This connection is used above all for transmitting power current for operating electric motors for opening and closing the contact arrangements of the two switching devices and for transmitting status, measuring, and control signals. The force required for a remote operation of this type is transferred from the drive 41, via a worm gear, to the drive disk 42 of the Geneva drive 40, as is apparent in FIG. 2.

The force can also be transmitted to the actuating device on-site, if necessary, using a crank handle 47. Depending on the direction of rotation of the crank handle, the two switching devices are brought into either the neutral position or into one of the two active positions, on-site.

In order to avoid damage events in the switchgear during manual operation on-site, a locking device which is apparent in FIGS. 3 to 10 is integrated into the actuating device. As represented in FIGS. 3, 4 and 7 to 10, the locking device contains a rocker bar arrangement 50 and four rocker bars 51, 52, 53, 54, each of which has a rotatably supported section 500 and an engagement body 501 fastened on this section, a closing disk 60, which cooperates with the rocker bar arrangement and is fastened on the drive shaft 10, an operating side 70 situated on a housing wall, and a slider 80, which is apparent only in FIGS. 4, 9 and 10.

Figure 4:
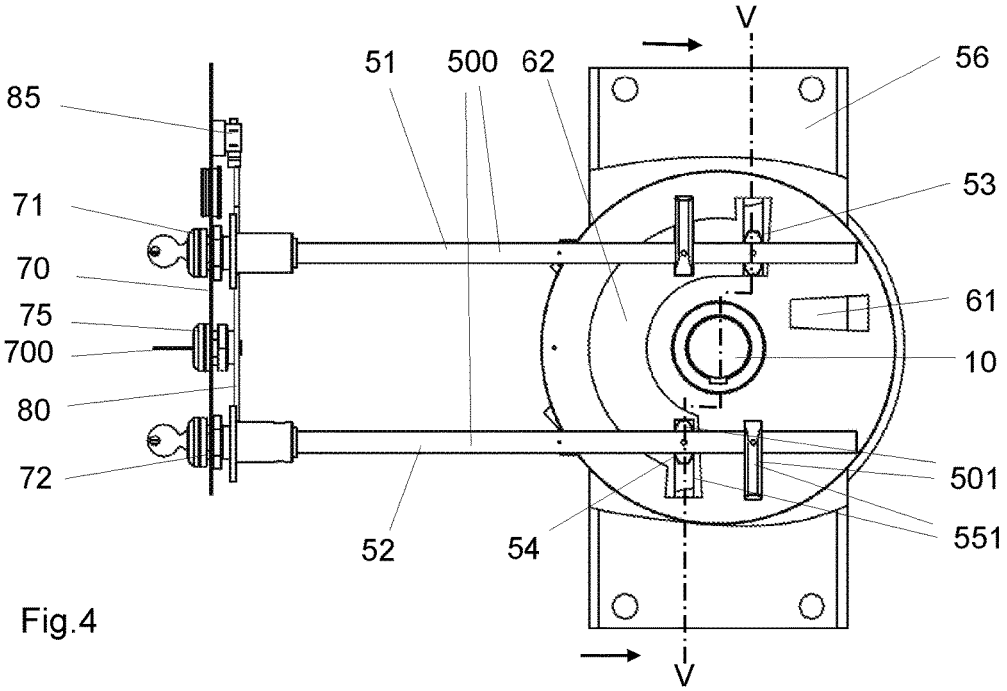
FIG. 4 shows a side view, from the right, of the locking device according to FIG. 3, in which a middle part of a plate 56 has been removed.
Figure 9:
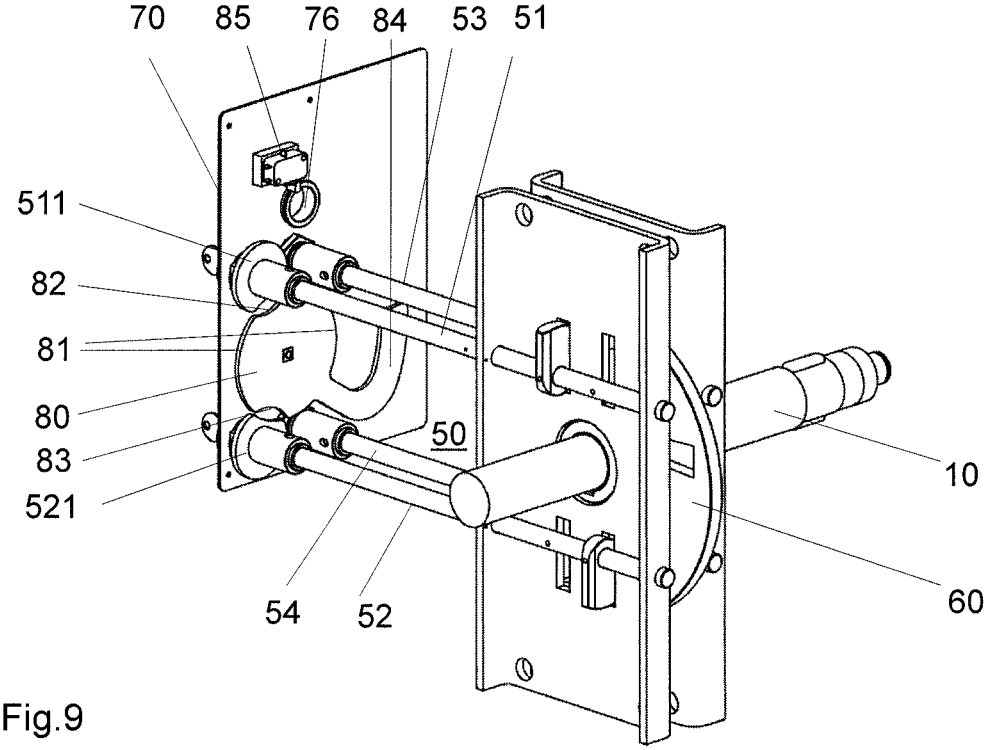
FIG. 9 shows a perspective view of the locking device according to FIG. 7, as viewed in the direction of an arrow IX, X, in which the access for the on-site actuation has been activated and the two switching devices have been unlocked.
Figure 10:
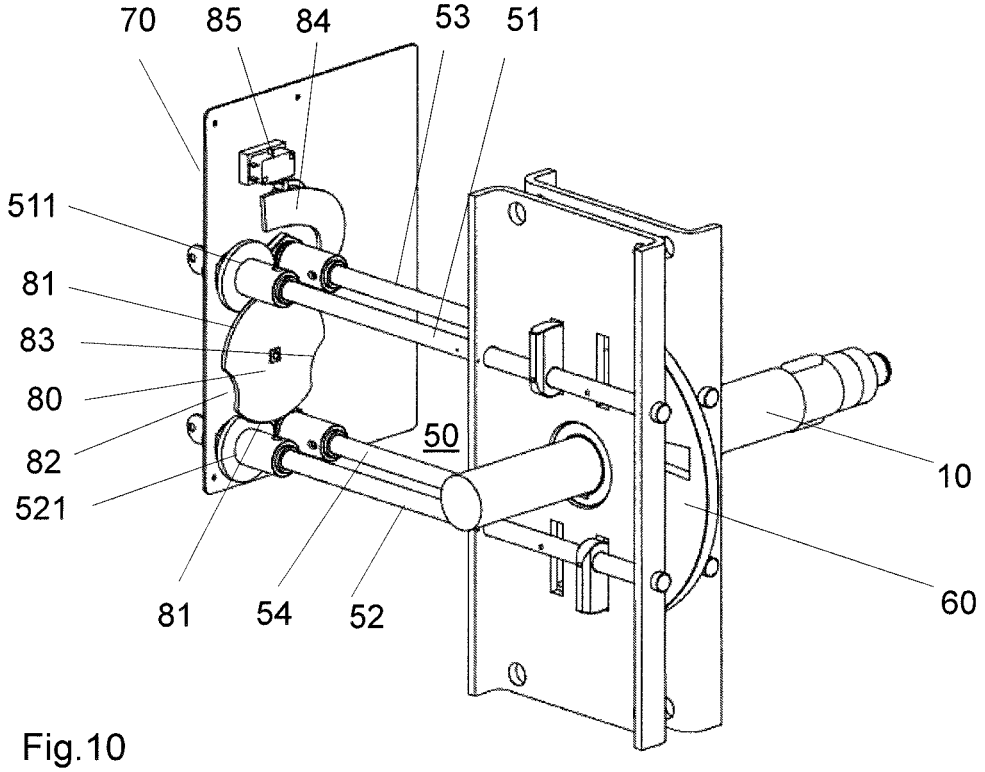
FIG. 10 shows a perspective view of the locking device according to FIG. 7, as viewed in the direction of the arrow IX, X, in which the access for the on-site actuation has been blocked and the access for the remote actuation has been activated.

As represented in FIG. 4, the slider 80 is rotatably supported inside the locking device, in a lock 75 which is inserted through the housing wall from the operating side 70, and can assume two positions, as shown in FIGS. 9 and 10. These two positions can be reached on-site by inserting a key 700, which is apparent in FIG. 4, into a lock 75 which is inserted through the operating side 70, and turning the key.

In FIG. 9, the slider 80 is located in a first of the two positions. In this position, the access for the on-site actuation is released and the access for the remote actuation is blocked. When the slider 80 is in this position, trained, authorized personnel can therefore manually set the first active position, the second active position, or the neutral position of the two switching devices with the aid of the crank handle 47 shown in FIG. 2, and can lock each of the three positions using the rocker bar device 50 and the closing disk 60. In this case, the rocker bar 51 engages into the closing disk 60 in the first active position and the rocker bar 52 engages into said closing disk in the second active position and, in the neutral position, the rocker bars 53 and 54 engage into the closing disk 60. If the withdrawn key 75 is in the possession of a person in the potential danger zone, it is therefore ensured that the on-site control cannot be reset to remote control by a third party.

In FIG. 10, the slider 80 is situated in a second position, in which the access for the on-site actuation is blocked and the actuation for the remote actuation is released, wherein the on-site key 75 for the slider remains inserted in this position and cannot be withdrawn. In this case, the slider 80 blocks the two rocker bars 51 and 52 by engaging into a circular disk 511 and 521, respectively, each of which is provided with a marginal cut-out, of the rocker bar 51 and 52, respectively, forming a form-locked connection with a holding arc 81, whereby an undesirable manual actuation of the two switching devices during remote control is avoided.

In the first position, which is apparent in FIG. 9, two marginal cut-outs 82, 83 in the holding arc 81 release the form-locked connection and, therefore, the blocking of the two rocker bars 51, 52. After the key is withdrawn from the lock 75, the slider 10 is blocked in the first or the second position.

The slider 80 further includes an arm 84 which, in its second position which is apparent in FIG. 10, switches a switching element 85 on, said switching element being used to switch a power supply on and off, which can be inserted through an opening 76 (FIG. 9) and is used for the remote-controlled actuation of the switchgear.

As is clear from FIG. 3, the four rocker bars 51, 52, 53 and 54 are each rotatably supported in one of four locks 71, 72, 73, 74 inserted through the housing wall on the operating side 70. Each of the four rocker bars can be moved, by turning a key 700 inserted into the associated lock, e.g., 71, into a closed position, in which the rocker bar, which is 51 in this case, engages via its engagement body 501 into the closing disk 60, forming a form-locked connection, and, by turning said key in the opposite direction, into an open position, in which the rocker bar, which is 51 in this case, is disengaged from the closing disk 60. After the key 700 is withdrawn from the lock, which is the lock 71 in this case, the associated rocker bar, which is rocker bar 51 in this case, is blocked in the closed or open position.

The closing disk 60, which is apparent in FIG. 4 in particular, has two cut-outs 61 and 62. During the locking of the access for the manual actuation of the switching devices, the rocker bar 51 engages into the cut-out 61 in the first active position and, in the second active position, the rocker bar 52 engages into said cut-out, forming a form-locked connection with the closing disk 60. During the locking of the access for the manual actuation of the switching devices in the neutral position, however, the two rocker bars 53 or 54 can engage into the cut-out 62, forming a form-locked connection with the closing disk 60 and, specifically, independently of the operating position of the key 73 and 74.

Figure 7:
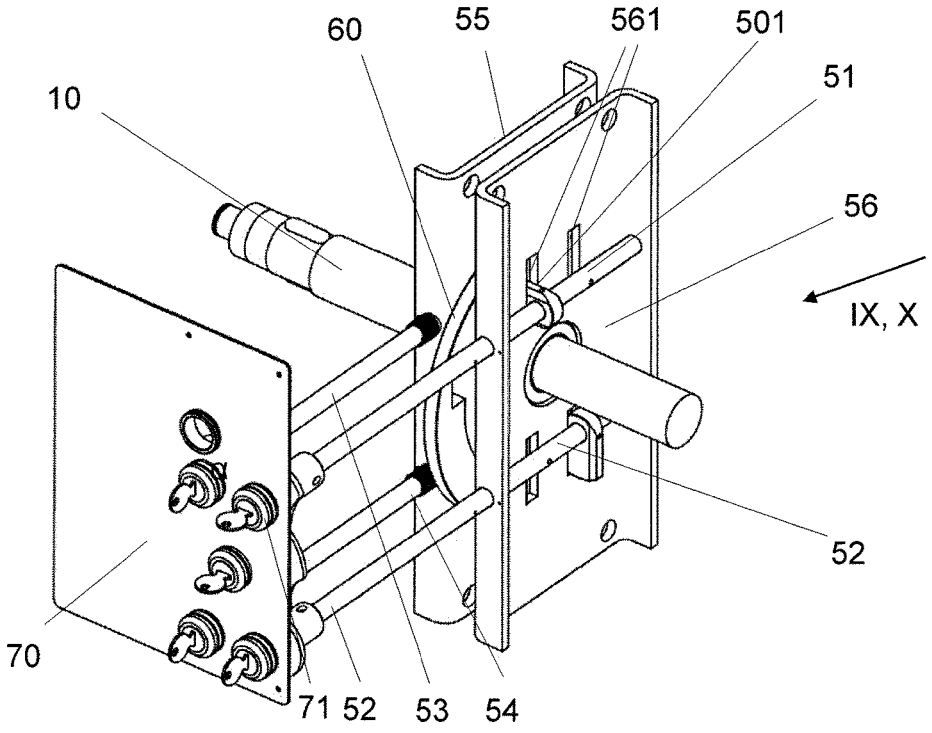
FIG. 7 shows a perspective view, after removal of a slotted wheel, of the locking device according to FIG. 3, which locks the two switching devices in a first active position.
Figure 8:
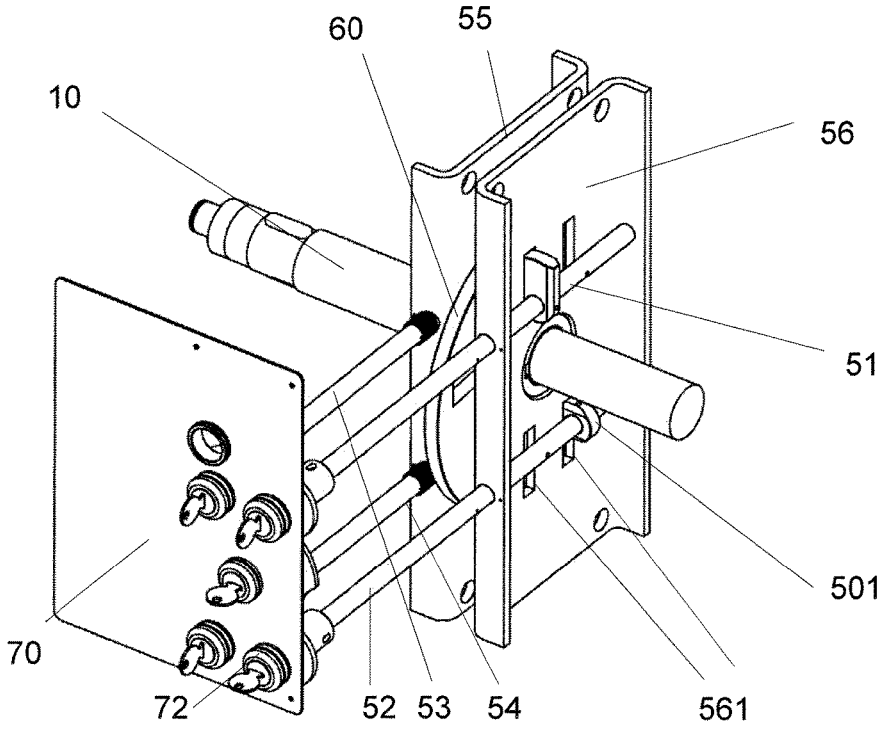
FIG. 8 shows the locking device according to FIG. 7, which now locks the two switching devices in a second active position.

As shown in FIG. 3, the closing disk 60 is situated between two fixed plates 55, 56 which are oriented perpendicular to the shaft 10 and through which the shaft extends. Four openings 551 are formed in the plate 55, and four openings 561, which are apparent in FIGS. 7 and 8, are formed in the plate 56. The openings 551 and 561 are disposed opposite one another in mirror symmetry and thereby form four pairs of openings, through which the engagement body 501 of one of the rocker bars can be inserted.

As is apparent, each of the two plates 55 and 56 is integrated into a main body, which has a U-shaped profile and comprises two limbs 552 and 562 attached to the plate 55 and 56, respectively. The section 500 of the two rocker bars 51 and 52 or 53 and 54, which is rotatably supported on the operating side 70, is inserted through at least one of the two limbs 552 and 562, respectively, and is rotatably supported on both limbs.

Figure 6:
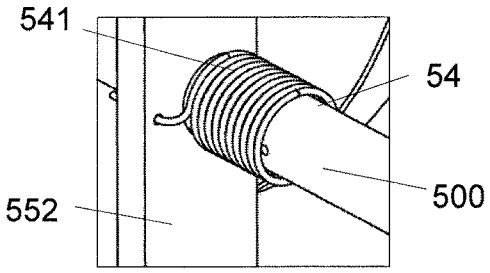
FIG. 6 shows an enlarged representation of a part VI of the locking device, which is outlined in FIG. 3.

The two rocker bars 53 and 54 are acted upon, counter to their direction of rotation from the open position into the closed position, by a preload which is applied by two torsion springs 531 and 541. FIG. 6 shows that, in order to achieve the preload, one end of the torsion spring 541 is held fixed on the limb 552 and the other end is held fixed on the rocker bar 54. The preload therefore prevents an uncontrolled engagement, caused by vibrations, for example, of the two rocker bars 53 and 54 into the cut-out 62 of the closing disk 60. Therefore, the rocker bars 53 and 54 remain in a form-locked engagement with the closing disk only if the keys 700 have been withdrawn from the associated locks 73 and 74.

The mode of operation of this locking device is as follows:

In the operating state represented in FIG. 3, in the neutral position of the two switching devices, for example TP and ES2, the locking device blocks the access for actuating the two switching devices. The slider is situated in the first position, which is apparent in FIG. 9, in which the slider 80 has blocked the access for the remote actuation by opening the switching element 85, i.e., by interrupting the current connection to the control room, and the two rocker bars 53 and 54 block the access for manually actuating the two switching devices TP and ES2 by engaging into the cut-out 62.

Figure 5:
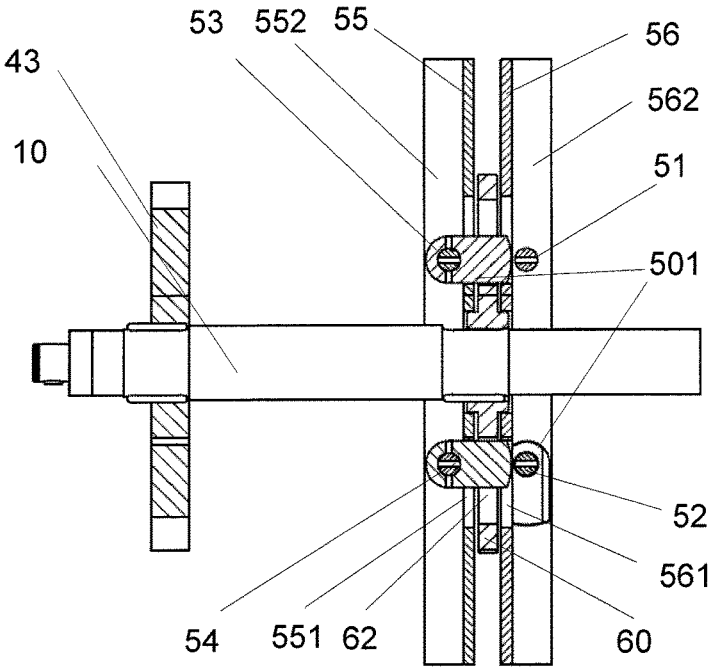
FIG. 5 shows a view of a section, cut along V-V, through the locking device according to FIG. 4, in which the plate 56 was made whole again.

As is clear from FIG. 5, the two engagement bodies of the rocker bars 53 and 54 then form a form-locked connection not only with the closing disk 60, but also with the plates 55 and 56, since they have each penetrated one pair of openings, each of which contains one of the four openings 551 and one of the four opposite openings 562. Forces transferred from the shaft 10 via the closing disk 10 onto the rocker bars may be substantially reduced by this form-locked connection.

If the intention is to move the switchgear out of the neutral position represented in FIG. 3 and into the first active position which is apparent in FIG. 7, first the two rocker bars 53 and 54 are pivoted by turning the keys in the two locks 73 and 74, thereby releasing the form-locked connection with the closing disk 60. With the aid of the crank handle 47 shown in FIG. 2, the shaft 10 is now rotated through the base angle, which is 90° in this case, whereupon the first active position is reached. When the rocker bar 51 is pivoted in the lock 71 with the aid of the key, a form-locked engagement of the rocker bar 51 into the cut-out 61 shown in FIG. 4 is achieved and, therefore, after the first active position has been reached, the access for the actuation of the two switching devices is locked.

If the intention is to manually move the switchgear out of the first active position and into the second active position, which is shown in FIG. 8, first the rocker bar 51 is pivoted by turning the key in the lock 71, whereupon the form-locked connection with the closing disk 60 is released. With the aid of the crank handle 47 shown in FIG. 2, the shaft 10 is now rotated in the opposite direction through twice the base angle, which is −180° in this case, whereupon the second active position is reached. When the rocker bar 52 is pivoted in the lock 72, a form-locked engagement of the rocker bar 52 into the cut-out 61 shown in FIG. 4 is achieved and, therefore, in the second active position, the access for the actuation of the two switching devices is blocked.

If the intention is to actuate the switchgear again, from the control room, starting from the neutral position of the two switching devices shown in FIGS. 3 to 5, the form-locked connection with the closing disk 60 is released by swiveling the two rocker bars 53 and 54 using the keys. Since none of the four rocker bars 51 to 54 now has a form-locked connection to the closing disk, the position shown in FIG. 10 can be reached by turning the slider 80 using the keys.

The locking device according to the invention is not limited to an enclosed generator circuit-breaker system which can be installed between a generator of a power plant and a transformer of a high-voltage network. This locking device can also be used in another circuit-breaker system, for example, a gas-insulated, metal-enclosed, high-voltage switchgear.

LIST OF REFERENCE NUMBERS

A axis
E ground
ES1, ES2 ground switch
G generator
GA generator lead
GP circuit-breaker pole
K encapsulation
L phase conductor
P circuit-breaker system pole
SP circuit-breaker pole of a start-up switch
TP circuit-breaker pole of a disconnect switch
TR transformer
α base angle
10 drive shaft
11 bent lever
12, 13 lever arms
20, 30 lever mechanism
40 intermittent-motion mechanism
41 drive
42 drive disk
43 slotted wheel
441, 442 grooves
45 crank pin
46 holding arc
461, 462, 463 cut-outs
50 rocker bar arrangement
51, 52, 53, 54 rocker bars
55, 56 plates
500 rotatable sections of the rocker bars
501 engagement body of the rocker bars
511, 521 circular disks of the rocker bars
531, 541 torsion springs
551, 561 openings
552, 562 limbs
60 closing disk
61, 62 cut-outs of the closing disk
70 operating side
71, 72, 73, 74, 75 locks
76 opening
700 key
80 slider
81 holding arc of the slider
82, 83 marginal cut-outs of the holding arc
84 arm
85 switching element

The invention claimed is:

1. A device for locking an access for actuating two switching devices of high-voltage switchgear with the aid of a drive shaft transmitting a drive force onto the two switching devices, said drive shaft being rotated, from a first active position of the two switching devices, in a clockwise direction through a base angle and, from a second active position of the two switching devices, being rotated in a counterclockwise direction through the base angle relative to an angle position of a neutral position of at least one of the two switching devices, the locking device comprises a closing disk which is fastened on the drive shaft, a rocker bar arrangement containing at least four rocker bars, and a slider, wherein the slider can be moved, on-site, into two slider positions, the first of which permits access for the on-site actuation and blocks actuation access from a remote location, and the second of which blocks the access for the on-site actuation and permits access from the remote actuation, wherein, in the first position of the slider, a first rocker bar can engage the closing disk, in the first active position, and a second rocker bar can engage said closing disk, in the second active position and, in the neutral position, a third rocker bar and a fourth rocker bar can engage the closing disk, and wherein the slider, in the second slider position, blocks the first rocker bar and the second rocker bar.

2. The device according to claim 1, wherein the slider includes an arm which, in the second position of the slider, switches a switching element on, the switching element being used for switching a power supply on and off, which is used for remote actuation of the switchgear.

3. The device according to claim 1, wherein the closing disk has cut-outs, and, during locking, the first rocker bar engages into a first cut-out of the cut-outs in the first active position and, in the second active position, the second rocker bar engages into the first cut-out of the cut-outs, forming a form-locked connection, and, in the neutral position, the third rocker bar and the fourth rocker bar engage into a second cut-out of the cut-outs.

4. The device of claim 1, further comprising the high-voltage switchgear, wherein the switchgear is designed as a generator circuit-breaker system and can be installed in a multi-phase high-voltage network, between a generator and a transformer, and comprising a disconnect-switch pole and a grounding switch on a transformer side of a load-switching generator circuit-breaker pole.

5. The device of claim 1, further comprising the high-voltage switchgear, which switchgear is designed as a generator circuit-breaker system and can be installed in a multi-phase high-voltage network, between a generator and a transformer, and comprising a pole of a start-up switch and a grounding switch on a generator side of a load-switching generator circuit-breaker pole.

6. The device according to claim 1, wherein the slider and the at least four rocker bars are each rotatably supported in one of five locks inserted through a housing wall on an operating side of the locking device.

7. The device according to claim 6, wherein the slider can be moved from the first slider position into the second slider position by turning a key inserted into an associated lock and, by rotating the key in the counterclockwise direction, said slider can be moved from the second position into the first position, and the slider is blocked in the first or second position after the key has been withdrawn.

8. The device according to claim 6, wherein each of the at least four rocker bars can be moved, by clockwise turning a key inserted into an associated lock, into a closed position, in which a moved rocker bar of the at least four rocker bars engages into the closing disk, forming a form-locked connection, and, by turning said key in the counterclockwise direction, into an open position, in which the moved rocker bar is disengaged from the closing disk, wherein each of the at least four rocker bars is blocked in the closed position after the key is withdrawn.

9. The device according to claim 6, wherein on a side of the housing wall facing away from the operating side, the slider includes a holding arc having two marginal cut-outs, and the first rocker bar and the second rocker bar respectively, each of which is provided with a marginal cut-out, wherein, in the second position of the slider, the holding arc has been inserted into the marginal cut-out of the first circular disk and into the marginal cut-out of the second circular disk, forming a form-locked connection, and wherein, in the first position of the slider, the two marginal cut-outs of the holding arc release a blocking of the first rocker bar and of the second rocker bar.

10. The device according to claim 6, wherein the slider includes an arm which, in the second position of the slider, switches a switching element on, the switching element being used for switching a power supply on and off, which is used for the remote-controlled actuation of the switchgear.

11. The device according to claim 7, wherein each rocker bar of the at least four rocker bars can be moved, by clockwise turning a key inserted into the associated lock, into a closed position, in which an associated rocker bar of the at least four rocker bars engages into the closing disk, forming a form-locked connection, and, by turning said key in a counterclockwise direction, into an open position, in which the associated rocker bar is disengaged from the closing disk, and wherein each rocker bar of the at least four rocker bars is blocked in the closed position after the key is withdrawn.

12. The device according to claim 7, wherein on a side of the housing wall facing away from the operating side, the slider includes a holding arc having two marginal cut-outs, and the first rocker bar and the second rocker bar respectively, each of which is provided with a marginal cut-out, wherein, in the second position of the slider, the holding arc has been inserted into the marginal cut-out of the first circular disk and into the marginal cut-out of the second circular disk, forming a form-locked connection, and wherein, in the first position of the slider, the two marginal cut-outs of the holding arc release a blocking of the first rocker bar and of the second rocker bar.

13. The device according to claim 7, wherein the slider includes an arm which, in the second position of the slider, switches a switching element on, the switching element being used for switching a power supply on and off, which is used for the remote-controlled actuation of the switchgear.

14. The device according to claim 8, wherein on the side of the housing wall facing away from the operating side, the slider includes a holding arc having two marginal cut-outs, and the first rocker bar and the second rocker bar respectively, each of which is provided with a marginal cut-out, wherein, in the second position of the slider, the holding arc has been inserted into the marginal cut-out of the first circular disk and into the marginal cut-out of the second circular disk, forming a form-locked connection, and wherein, in the first position of the slider, the two marginal cut-outs of the holding arc release a blocking of the first rocker bar and of the second rocker bar.

15. The device according to claim 8, wherein the slider includes an arm which, in the second position of the slider, switches a switching element on, the switching element being used for switching a power supply on and off, which is used for the remote-controlled actuation of the switchgear.

16. The device according to claim 8, wherein the third rocker bar and the fourth rocker bar are acted upon by a preload counter to their direction of rotation from the open position into the closed position.

17. The device according to claim 16, wherein the preload is applied by two torsion springs, wherein one end of at least one torsion spring of the two torsion springs is fixed and another end is held on one of the third and fourth rocker bars.

18. The device according to claim 1, wherein the closing disk is situated between two fixed plates which are oriented perpendicular to the drive shaft and through which the shaft extends, and at least four openings are formed in the two plates in such a way that, during locking, in the first active position, a rockable engagement body of the first rocker bar is inserted through a first opening of the at least four openings and, in the second active position, a rockable engagement body of the second rocker bar is inserted through a second opening of the at least four openings, forming a form-locked connection with the closing disk, and, in the neutral position, a rockable engagement body of the third rocker bar is inserted through a third opening and a rockable engagement body of the fourth rocker bar is inserted through a fourth opening of the at least four openings, forming a form-locked connection with the closing disk.

19. The device according to claim 18, wherein each plate has four openings which are mirror-symmetrically disposed on both plates, forming four pairs of openings, wherein, during locking, the engagement body of at least one of the four rocker bars is inserted through at least one of the four pairs, forming the form-locked connection with the closing disk.

20. The device according to claim 18, wherein at least one of the two plates is integrated into a main body which has a U-shaped profile and has two limbs attached to the one of the two plates, and in that a section of at least one of the four rocker bars, which is rotatably supported on an operating side, is inserted through at least one of the two limbs and is rotatably supported on both limbs.

* * * * *